US005727341A

United States Patent [19]

Saylor

[11] Patent Number: 5,727,341

[45] Date of Patent: Mar. 17, 1998

[54] BOOT HOLSTER

[76] Inventor: Daniel A. Saylor, 111 Laurel Oak Dr., Longwood, Fla. 72779

[21] Appl. No.: 752,395

[22] Filed: Nov. 20, 1996

[51] Int. Cl.[6] ..... A43B 23/24

[52] U.S. Cl. ..... 36/136; 224/911; 224/587; 36/1

[58] Field of Search ..... 36/1, 50.1, 88, 36/89, 100, 101, 132, 136, 138; 224/911, 191, 665, 587

[56] References Cited

U.S. PATENT DOCUMENTS

| | | | |
|---|---|---|---|
| 229,290 | 6/1880 | Weaver | 36/50.1 |
| D. 280,567 | 9/1985 | Ji | 36/100 |
| 335,256 | 2/1886 | Tyler, Jr. | 36/50.1 |
| 348,233 | 8/1886 | Phalan | 36/136 |
| 1,131,509 | 3/1915 | Hansen | 36/50.1 |
| 2,489,368 | 11/1949 | Faybert | 36/1 |
| 4,777,743 | 10/1988 | Roehrig, Jr. | 36/136 |

*Primary Examiner*—Paul T. Sewell
*Assistant Examiner*—Anthony Stashick

[57] ABSTRACT

A boot holster is provided as may be used by a police officer or military personnel for carrying a concealed weapon. The holster includes a rear strap loop which receives a flexible strap fixed along the top portion of the boot. A pistol strap is permanently affixed to the holster along the rear thereof and is releasably affixed to the front of the holster whereby the pistol can be easily removed as needed.

10 Claims, 3 Drawing Sheets

BOOT HOLSTER

BACKGROUND OF THE INVENTION

1 . Field of the Invention

The invention herein pertains to a holster for a firearm and particularly pertains to a holster for attachment to a wearer's boot for carrying a concealed weapon.

2 . Description of the Prior Art And Objectives Of The invention

Law enforcement officers and others in recent years have increased adoption of concealed weapons. Many officers may carry a relatively large caliber firearm as a primary weapon and a second, smaller caliber weapon as a secondary or backup. Pistol holsters are often concealed along the inside of the ankle by attaching the holster directly to the swearer's leg. In recent years boots have become increasingly popular with law enforcement officers, military personnel and others who carry concealed weapons. As a result, the present invention was conceived and one of its objectives is to provide a holster which can be releasably, conveniently positioned on a boot in a simple and secure manner.

It is yet another objective of the present invention to provide a boot holster which includes a strap loop for engagement with a holster strap affixed to the boot.

It is still another objective of the present invention to provide a holster having a pistol strap for securing and maintaining a pistol in the holster during rigorous activities such as running.

It is also an objective of the present invention to provide a gun holster which can be concealed under a wearer's pants leg yet one from which the gun can be quickly removed if needed.

It is a further objective of the present invention to provide a combination gun holster and boot in which the boot includes a releasable holster strap.

Various other objectives and advantages of the present invention will become apparent to those skilled in the art as a more detailed description is set forth below.

SUMMARY OF THE INVENTION

The aforesaid and other objectives are provided by a gun holster which can be used in combination with a specially designed boot for carrying a pistol in a concealed fashion. The holster includes a strap loop affixed to the back thereof, such as by sewing, which slidably engages a flexible holster strap which is releasably affixed such as by snaps, to the leg portion of the boot. While only a left boot and holster are shown in the accompanying drawings, an identical left-handed holster can be manufactured for use on a right boot as needed for left-handed personnel.

DETAILED DESCRIPTION OF THE PREFERRED EMBODIMENT AND OPERATION OF THE INVENTION

Figures 1, 2:
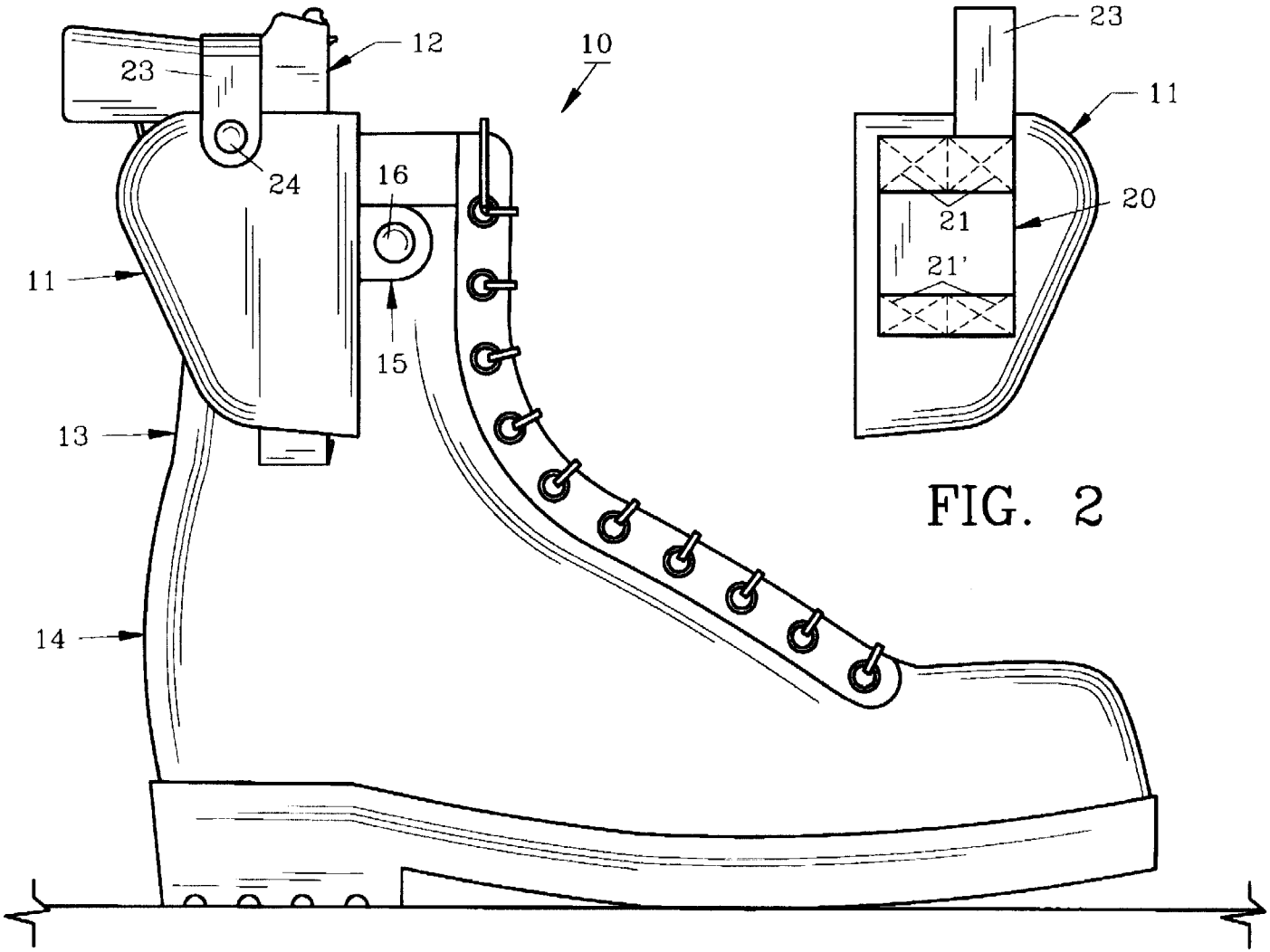
FIG. 1 illustrates a left boot with a holster attached to the inside leg portion thereof, as would be worn by a right-handed police officer.
FIG. 2 shows a rear view of the holster as shown in FIG. 1 removed from the boot.
Figure 3:
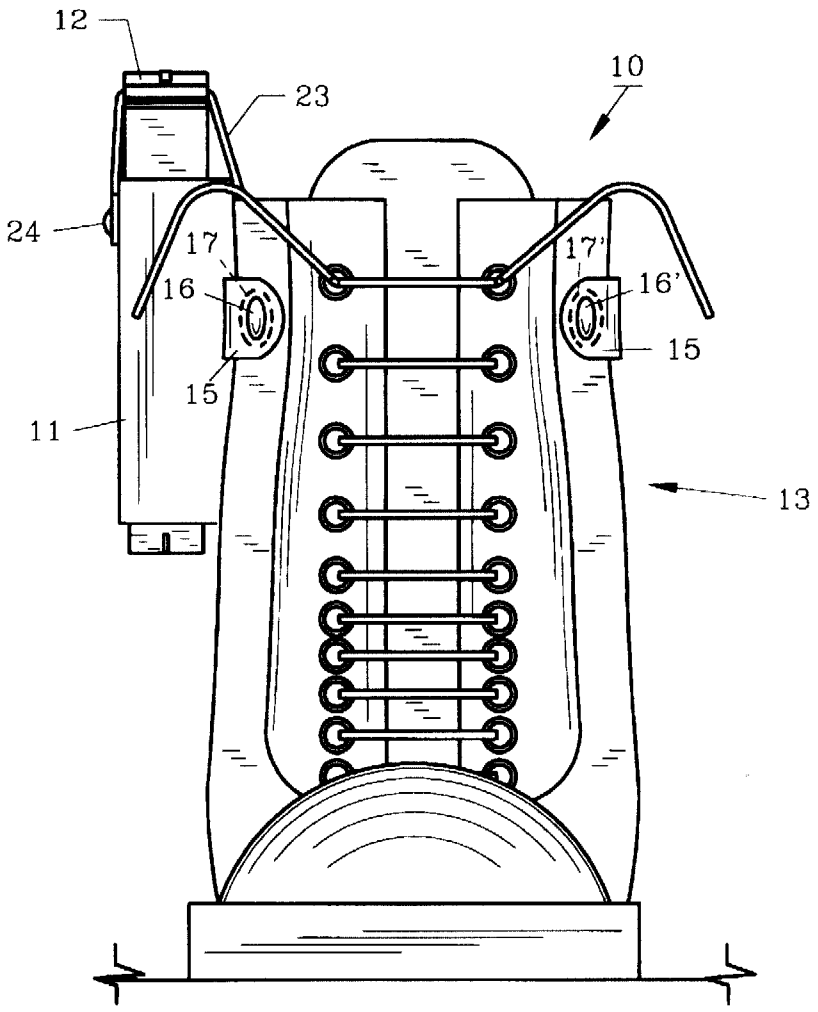
FIG. 3 is a front elevational view of the holster and boot combination as seen in FIG. 1.
Figure 4:
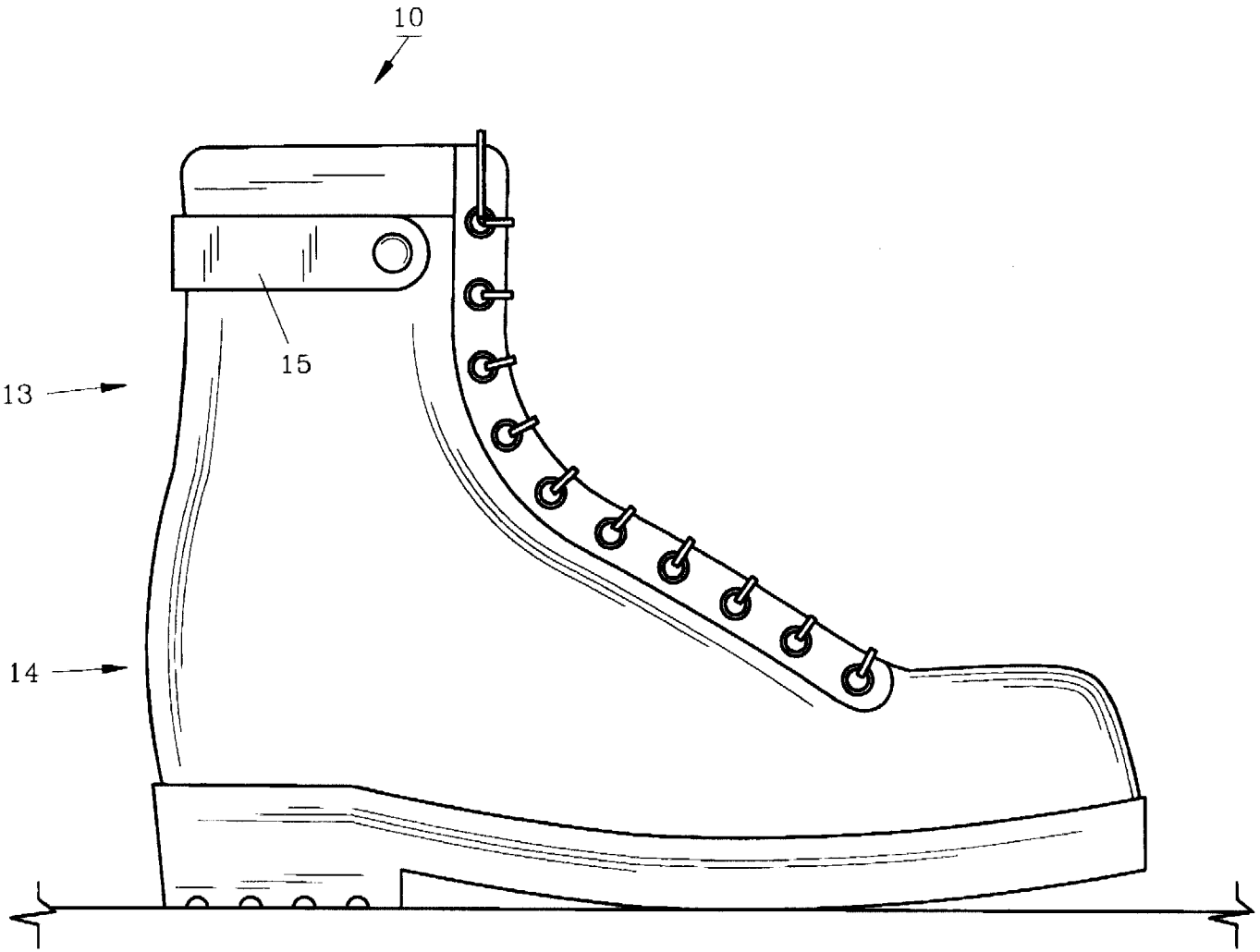
FIG. 4 demonstrates the boot as shown in FIG. 1 with the holster removed, the right boot (not shown) being a mirror image thereof.

For a better understanding of the invention and it operation, turning now to the drawings, FIG. 1 illustrates the preferred combination of the invention whereby left boot 10 in the preferred form, is affixed to preferred gun holster 11, for carrying pistol 12. Pistol 12 may consist of a conventional .22 caliber automatic pistol, although other calibers and type of weapons may also be carried. Holster 11 is affixed to the inside of boot 10 along the leg portion (generally shown by arrow 13) which is integrally formed, as is standard, with foot portion 14 of boot 10. As seen, holster 11 is positioned slightly above the wearer's ankle area and may be concealed by the trousers of the wearer. Pistol 12 would then be conveniently available for a right-handed user and, of course, for a left-handed user a mirror image of holster 11 can be manufactured for attachment to the right boot (not seen) of the wearer, also along the inside thereof. Holster 11 is affixed to boot 10 by means of flexible strap 15 which is releasably attached to boot 10 by male snap member 16. Female snap members 17, 17' (FIG. 3) are positioned directly below snap members 16, 16' on boot 10. Strap 15 passes completely around the rear of left portion 13 of boot 10, as shown in FIGS. 3 and 4, and attaches to the outside surface thereof by snaps 16, 16', as shown in FIG. 3. Strap 15 is formed of a thin, flexible material such as leather, vinyl or may be formed of a resilient material such as a suitable elastomeric or rubber material. Strap 15 passes through loop 20 affixed by stitching 21, 21' to holster 11 as seen in FIG. 2. Stitching 20 likewise secures flexible pistol strap 23 which is releasably fastened by male snap member 24 as seen in FIGS. 1 and 3 to a female snap member (not shown) on holster 11.

Holster 11 can be quickly attached to boot 10 or when not needed, quickly removed therefrom without removing pistol 12 contained therein. In use, strap 23 can be easily unfastened and pistol 12 drawn as needed.

The examples and illustrations shown herein are for explanatory purposes and are not intended to limit the scope of the appended claims.

I claim:

1. A gun holster and boot in combination, said boot comprising a holster strap, said holster strap having two ends, said holster strap separately releasably attached at each end to said boot, said holster comprising a loop whereby said holster strap engages said loop to hold said holster on said boot, whereby each of said holster strap ends can be released independently of the other end.

2. The combination of claim 1 wherein said holster further comprises a pistol strap, said pistol strap releasably connected to said holster.

3. The combination of claim 1 further comprising means to releasably attach said holster strap, said attaching means positioned at each end of said holster strap.

4. The combination of claim 3 wherein said attaching means comprises a snap member.

5. The combination of claim 1 wherein said holster strap circumscribes the rear of said boot, and wherein said ends of said holster strap are peripherally spaced on said boot.

6. The combination of claim 1 wherein said boot further comprises a leg portion, said holster strap positioned on said leg portion.

7. A boot for supporting a gun holster comprising:

a foot portion, a leg portion, said foot portion attached to said leg portion, a holster strap, said holster strap having two ends, means to attach said holster strap to said boot, said attaching means for releasably attaching each of said ends of said holster strap to said leg portion, whereby one end of said holster strap can be attached independently of the second end.

8. The boot of claim 7 wherein said strap is flexible.

9. The boot of claim 7 wherein said strap circumscribes the rear of said leg portion, and wherein said ends of said holster strap are peripherally spaced thereon.

10. A gun holster and boot in combination, said boot comprising:

a) a flexible holster strap, said holster strap having two ends, said ends peripherally spaced on said boot, said holster strap circumscribing the rear of said boot, said holster strap separately releasably attached at each end to said boot, and b) means to releasably attach said holster strap, said attaching means positioned at each end of said holster strap, said attaching means comprises a snap member, said holster comprising:

a loop whereby said holster strap engages said loop to hold said holster on said boot, whereby each of said holster strap ends can be released independently of the other end.

* * * * *